US011345576B2

(12) United States Patent
Webster

(10) Patent No.: US 11,345,576 B2
(45) Date of Patent: May 31, 2022

(54) HINGED CARRIAGE DECK FOR VERTICAL RECIPROCATING CONVEYOR

(71) Applicant: Pflow Industries, Inc., Milwaukee, WI (US)

(72) Inventor: Mark Webster, Hubertus, WI (US)

(73) Assignee: Pflow Industries, Inc., Milwaukee, WI (US)

( * ) Notice: Subject to any disclaimer, the term of this patent is extended or adjusted under 35 U.S.C. 154(b) by 117 days.

(21) Appl. No.: 16/266,226

(22) Filed: Feb. 4, 2019

(65) Prior Publication Data

US 2020/0247650 A1 Aug. 6, 2020

(51) Int. Cl.

| | |
|---|---|
| ***B66F 7/18*** | (2006.01) |
| ***B66F 7/28*** | (2006.01) |
| ***B66F 7/22*** | (2006.01) |

(52) U.S. Cl.

CPC ..... *B66F 7/18* (2013.01); *B66F 7/22* (2013.01); *B66F 7/28* (2013.01); *B66F 2700/057* (2013.01)

(58) Field of Classification Search

CPC .... B66F 7/00; B66F 7/02; B66F 7/025; B66F 7/04; B66F 7/10; B66F 7/12; B66F 7/14; B66F 7/22; B66F 7/28; B66F 9/02; B66F 9/04; B66F 9/07; B66F 9/16; B66F 9/254165; B66F 7/18; Y10T 403/32254; Y10T 403/32262; Y10T 403/32319; Y10T 403/32418; Y10T 403/32426; Y10T 403/32442; Y10T 403/32918; Y10T 403/32951; Y10T 403/32967; Y10T 403/32327; Y10T 403/32336; Y10T 403/32361

USPC ..... 254/3 R, 3 C, 4 R, 4 C, 931; 403/83, 84, 403/91, 103, 104, 106, 157, 161, 163

See application file for complete search history.

(56) References Cited

U.S. PATENT DOCUMENTS

| | | | | |
|---|---|---|---|---|
| 2,873,987 | A * | 2/1959 | Larson | A47B 3/08 403/61 |
| 3,800,915 | A | 4/1974 | Himes | |
| 4,875,547 | A | 10/1989 | Hanthorn | |
| 5,284,414 | A | 2/1994 | Kempf | |
| 5,782,317 | A * | 7/1998 | Lutz | B65G 1/02 187/270 |
| 7,491,026 | B2 | 2/2009 | Hooker | |
| 8,079,444 | B1 | 12/2011 | Rands et al. | |
| 8,403,615 | B1 | 3/2013 | McGlinn et al. | |
| 9,028,195 | B1 | 5/2015 | Heynssens | |

(Continued)

*Primary Examiner* — Lee D Wilson
*Assistant Examiner* — Alberto Saenz
(74) *Attorney, Agent, or Firm* — Andrus Intellectual Property Law, LLP

(57) ABSTRACT

A vertical reciprocating conveyor that can be transported in a storage condition and assembled at a work facility in an operating condition. The vertical reciprocating conveyor includes a carriage assembly that is movable along a pair of spaced vertical rails of a support frame. The carriage assembly includes a pair of spaced uprights and a carriage deck designed to support material moved along the pair of spaced vertical rails of the support frame. The carriage deck is movable between an operating condition and a storage condition, where the carriage deck is perpendicular to the pair of spaced uprights in the operating condition and parallel to the pair of spaced uprights in the storage condition. The movement of the carriage deck allows the overall size of the vertical reciprocating conveyor to be reduced for shipping.

5 Claims, 10 Drawing Sheets

(56) References Cited

U.S. PATENT DOCUMENTS

| | | | | |
|---|---|---|---|---|
| 9,255,419 | B2 | 2/2016 | Stokes, Sr. et al. | |
| 9,656,590 | B2 * | 5/2017 | Johnson | A47C 17/80 |
| 2008/0138183 | A1 | 6/2008 | Lin | |

* cited by examiner

HINGED CARRIAGE DECK FOR VERTICAL RECIPROCATING CONVEYOR

BACKGROUND

The present disclosure relates to a vertical reciprocating conveyor. More specifically, the present disclosure relates to a vertical reciprocating conveyor that includes a carriage assembly having a carriage deck that can pivot between an operating condition and a storage condition.

Vertical reciprocating conveyors typically include a carriage that is mounted between two vertical columns of a support frame and is movable between multiple vertical positions. The carriage assembly typically includes a pair of vertical upright members and a carriage deck that is welded to the vertical uprights. The carriage deck extends perpendicular to the vertical uprights and the support frame to support material being moved between the different vertical levels. In typical designs, the carriage deck is fixed in the perpendicular position such that the carriage deck extends away from the conveyor support frame.

When the vertical reciprocating conveyor is shipped to a facility after manufacture, the carriage assembly is either separate from the rest of the vertical conveyor and installed onsite or the entire conveyor assembly is shipped as a unit. When shipping the vertical reciprocating conveyor as a unit, additional storage space is required to handle the perpendicular carriage deck. Alternatively, if the carriage deck is installed onsite, the installer must ensure that the carriage deck is installed in a proper manner such that the carriage deck can support the weight of cargo and materials being lifted. When the deck is shipped detached from the vertical uprights, the deck must be installed onsite, which typically involves welding onsite, thus requiring trained welders to be present at installation.

It is an object of the present disclosure to provide a vertical reciprocating conveyor that has a carriage deck that is movable between an operating condition and a storage condition to facilitate shipping while eliminating the need for assembly onsite.

SUMMARY

The present disclosure relates to a vertical reciprocating conveyor for moving materials between different vertical levels. The vertical reciprocating conveyor of the present disclosure is designed to have a reduced size for shipment while being able to be assembled into an operating condition onsite for use.

The vertical reciprocating conveyor includes a frame that includes a pair of spaced vertical rails. The frame is designed for support on a support surface, such as the floor of the facility where the vertical reciprocating conveyor is installed for use. The pair of spaced vertical rails each extends between a lower end and an upper end and define the path of movement for a carriage assembly.

The carriage assembly of the vertical reciprocating conveyor is movable by a drive mechanism along the pair of spaced vertical rails between a plurality of vertical positions. The carriage assembly includes a pair of spaced uprights that can include rollers to allow the entire carriage assembly to move along the length of the pair of spaced vertical rails. A carriage deck is pivotally mounted to the pair of spaced uprights. The carriage deck is movable between an operating condition in which the carriage deck is perpendicular to the pair of spaced uprights and a storage condition in which the carriage deck is generally parallel to the pair of spaced uprights. When the carriage deck is in the storage condition, the overall size of the vertical reciprocating conveyor is reduced, which is beneficial for shipping the vertical reciprocating conveyor from a manufacturing facility.

In one embodiment of the disclosure, the carriage assembly includes a pair of pivot brackets that are each mounted to one of the pair of spaced uprights of the carriage assembly. Each of the pivot brackets receives one of a pair of spaced side beams that form the carriage deck. Each of the side beams are pivotally mounted to the pivot brackets such that the carriage deck is movable between the storage and operating conditions.

In one embodiment of the disclosure, the side beams are each mounted to one of the pivot brackets utilizing a pivot pin that extends through the pivot bracket and one of the side beams. The position of the pivot pin is spaced from an inner end of the side beam such that the side beam is pivotally mounted to the mounting bracket at a location spaced from its inner end. In one embodiment of the disclosure, a locking pin is positionable to secure the side beams to the mounting bracket when the carriage deck is in the operating condition. The locking pins are removed to allow the pivoting movement of the side beams relative to the pivot brackets. In contemplated uses, both the pivot pins and the locking pins can be removed and the entire carriage deck can be separated from the spaced uprights of the carriage assembly for transportation. The pivot pins and locking pins can re reinstalled on-site to fully assembly the carriage assembly without the need for welding on-site.

In accordance with the above description, the carriage deck of the carriage assembly is movable between operating and storage conditions to reduce the size of the vertical reciprocating conveyor during shipment while allowing the assembly of the vertical reciprocating conveyor onsite without the need for welding.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
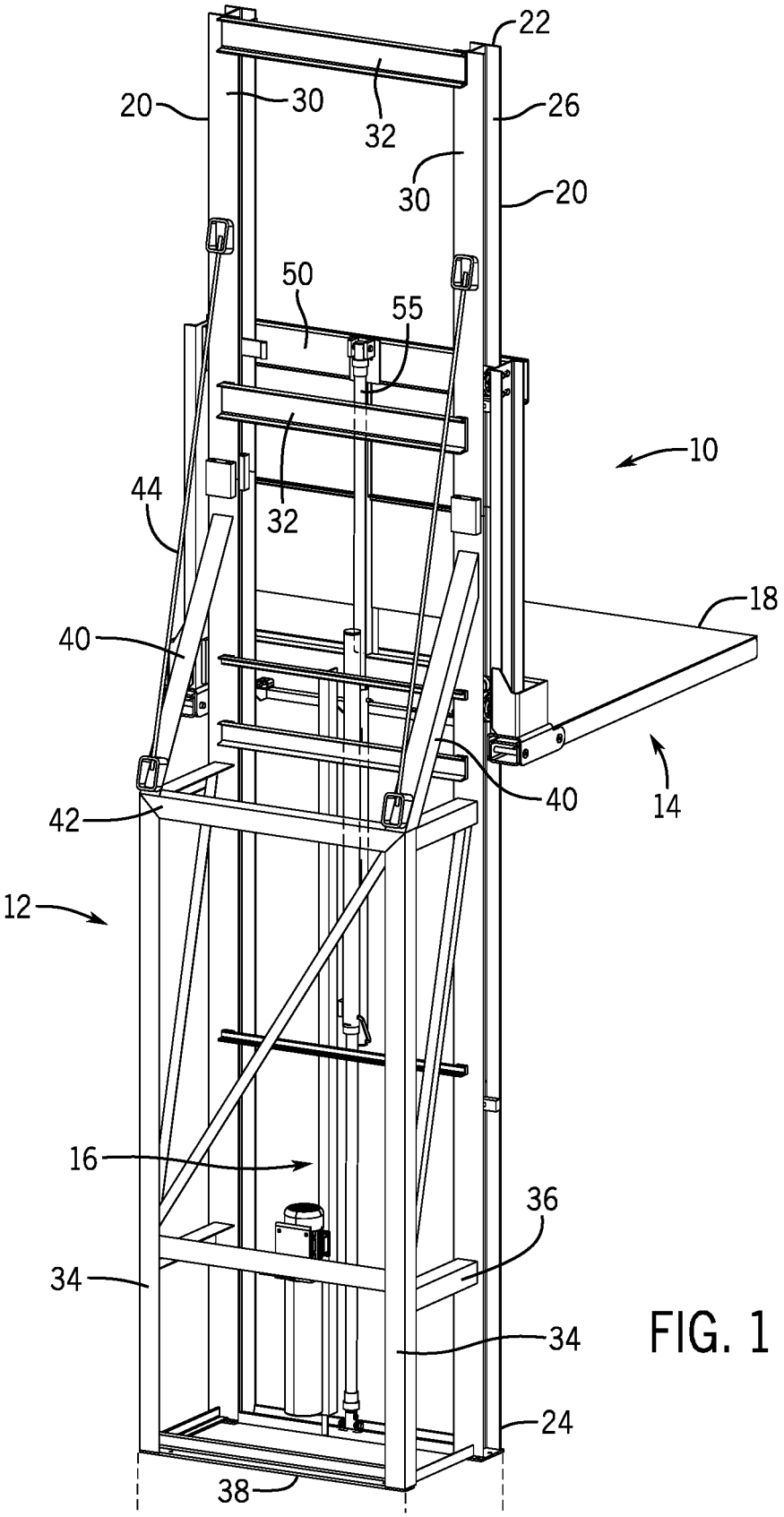
FIG. 1 is a rear perspective view of the vertical reciprocating conveyor of the present disclosure.

FIG. 1 illustrates a vertical reciprocating conveyor 10 that is adapted to move material or cargo between different vertical levels such as, for example, a first floor or level and a second floor or level. The conveyor 10 includes a support frame 12 that allows the vertical reciprocating conveyor 10 to be freestanding on a floor or other type of support structure. The support frame 12 provides structural support for a carriage assembly 14 that moves along the support frame 12 to move material or cargo from the different levels within a facility. The carriage assembly 14 is moved vertically by a drive mechanism 16. Although the drive mechanism 16 can be various different types of driving arrangements, in the embodiment illustrated, the drive mechanism 16 is a series of hydraulic cylinders that are connected to the carriage assembly 14. Other types of drive mechanisms, such as a chain drive or rack and pinion gear assembly are contemplated as being within the scope of the present disclosure.

Figure 7:
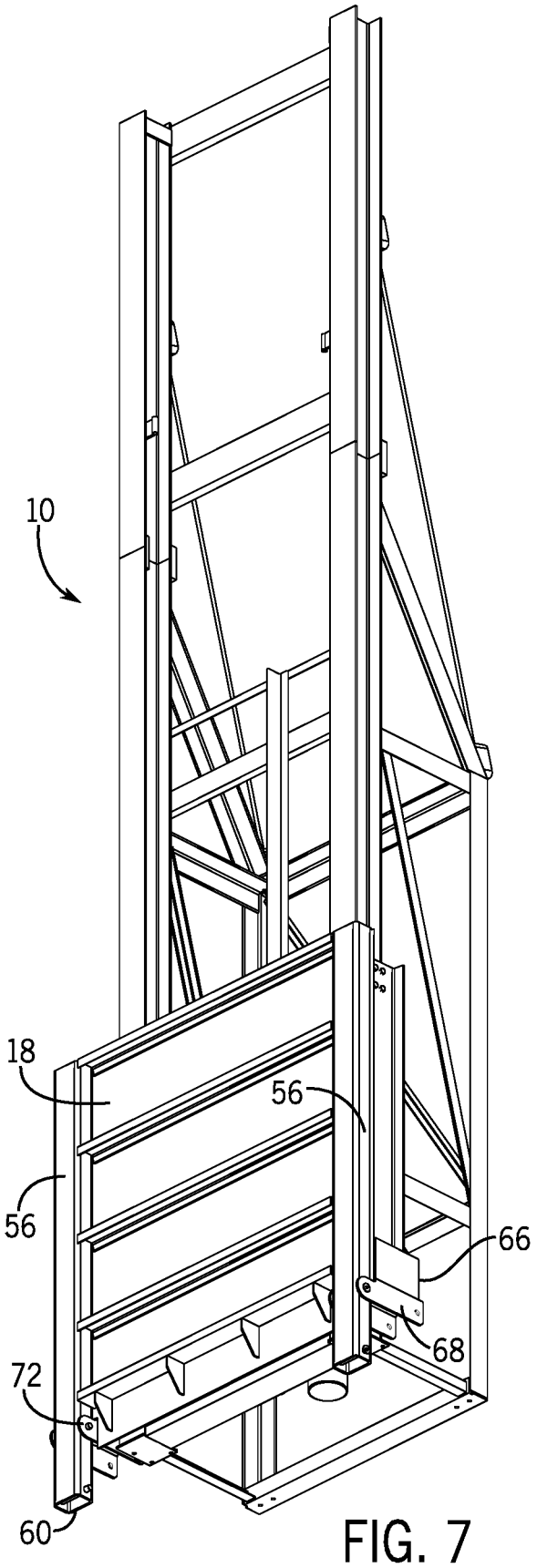
FIG. 7 is a front perspective view illustrating the carriage deck in the storage condition.
Figure 8:
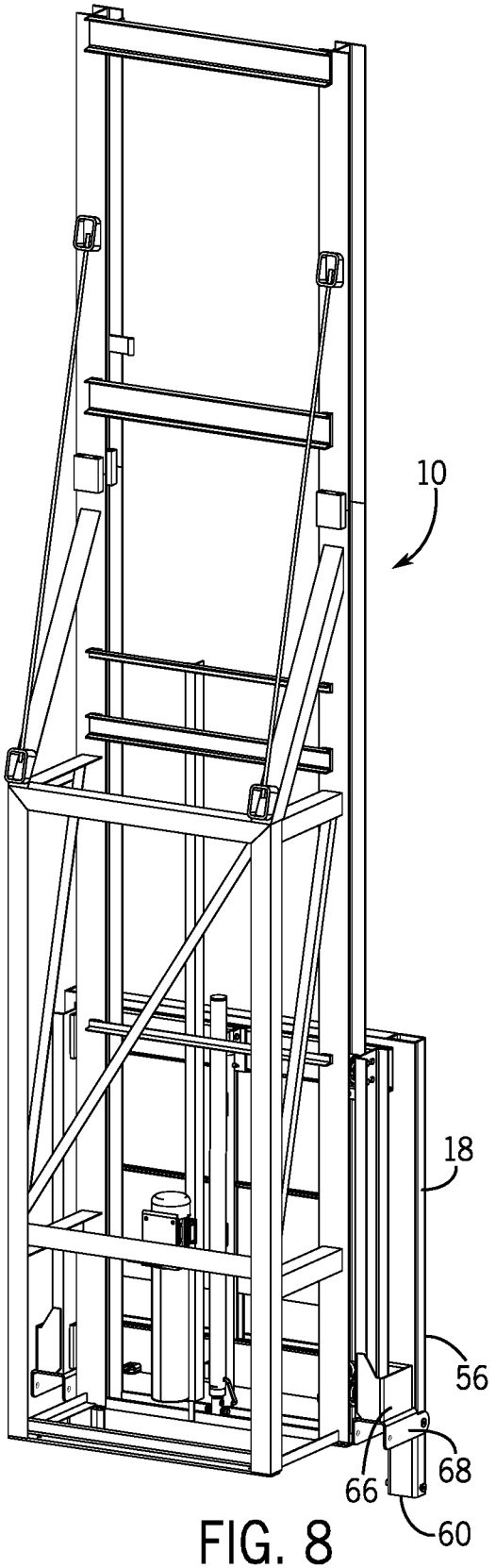
FIG. 8 is a rear perspective view with the carriage deck in the storage condition.

The vertical reciprocating conveyor 10 of the present disclosure is designed to be preassembled at a manufacturing facility and shipped as a completed unit for installation at a desired location, such as a storage facility. In order to facilitate shipping and to reduce shipping size, the carriage assembly 14 is designed with a carriage deck 18 that can be moved from the operating condition shown in FIG. 1 to the storage condition shown in FIGS. 7-8. When the carriage deck 18 is in the storage condition of FIGS. 7-8, the width of the entire vertical reciprocating conveyor 10 is reduced relative to the operating condition, which facilitates shipping. The details of the carriage assembly 14 and support frame 12 that facilitate the shipping of the vertical reciprocating conveyor 10 in the storage condition shown in FIGS. 7 and 8 will be described in greater detail below.

Referring back to FIGS. 1 and 2, the support frame 12 is designed including a pair of spaced vertical rails 20 that define the path for the carriage assembly 14. Each of the vertical rails 20 extends between an upper end 22 and a lower end 24. The lower end 24 is designed to be mounted to a supporting structure such that the length of the vertical rails 20 between the upper end 22 and the lower end 24 define the movement path for the carriage assembly 14.

Figure 2:
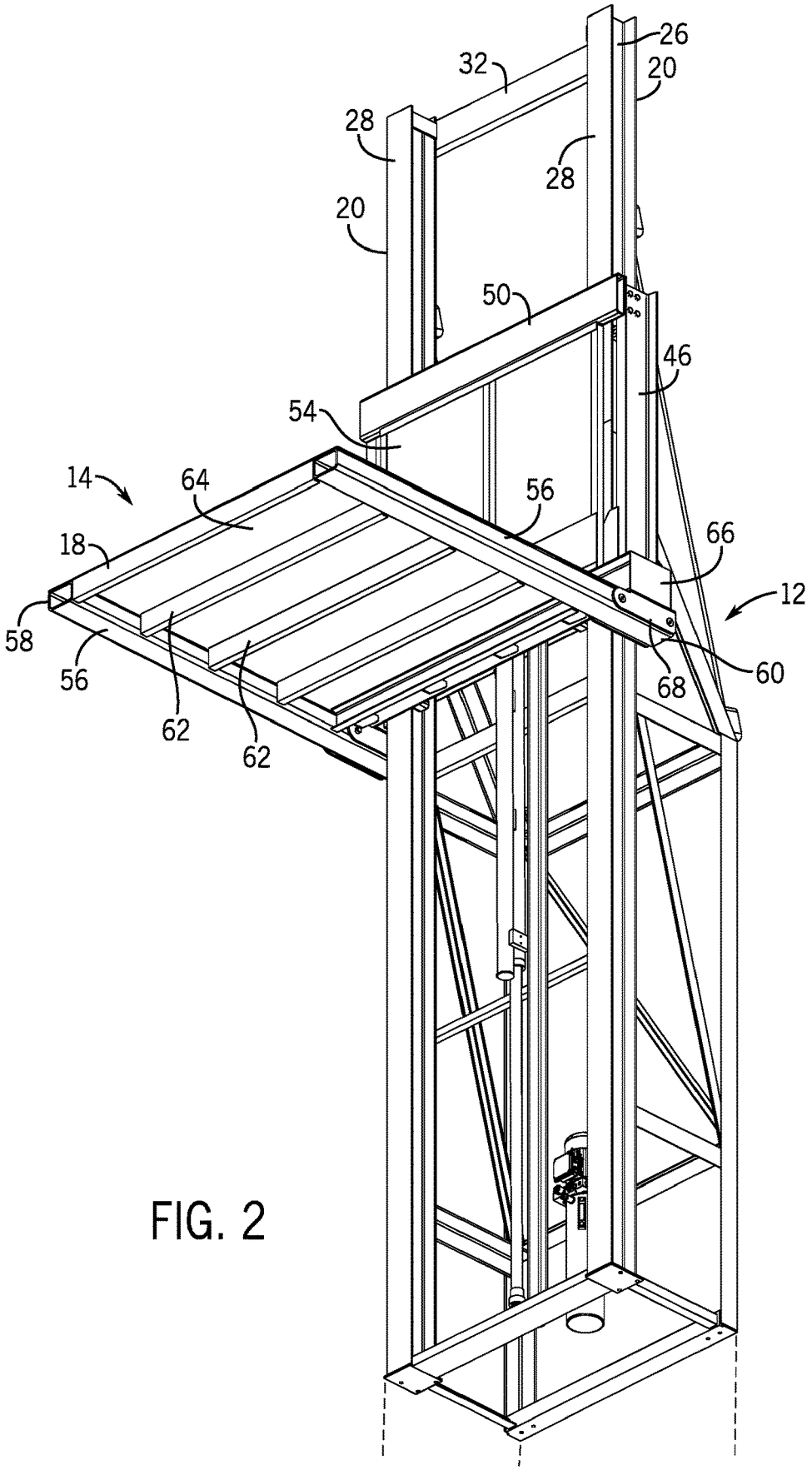
FIG. 2 is a front perspective view of the vertical reciprocating conveyor with the carriage assembly in the raised position.

In the embodiment shown in FIGS. 1 and 2, each of the vertical rails 20 is formed as an I-beam that defines a roller slot 26 located between a first wall 28 and a second wall 30. The support frame 12 includes a series of cross supports 32 that are each securely attached between the spaced vertical rails 20 to provide support for the vertical rails 20. The cross supports 32 can be connected to the vertical rails 20 utilizing any type of attachment technique, such as welding or bolting.

The support frame 12 includes a pair of back support legs 34 that, in the embodiment shown in FIG. 1, are connected to the vertical rails 20 by a series of supports 36. The combination of the back support legs 34 and the vertical rails 20 define a base 38 for supporting the support frame 12 on a support surface. In the embodiment shown in FIG. 1, a pair of angled braces 40 extends between the top end of each of the back support legs 34 to provide additional support for the portion of the vertical rails 20 extending upwardly past the top ends 42 of the back support legs. Tie rods 44 provide additional support for the upper portion of the vertical rails 20 to aid in supporting the weight of the carriage assembly 14 and any supported material when the carriage assembly 14 reaches its uppermost positions.

Figure 3:
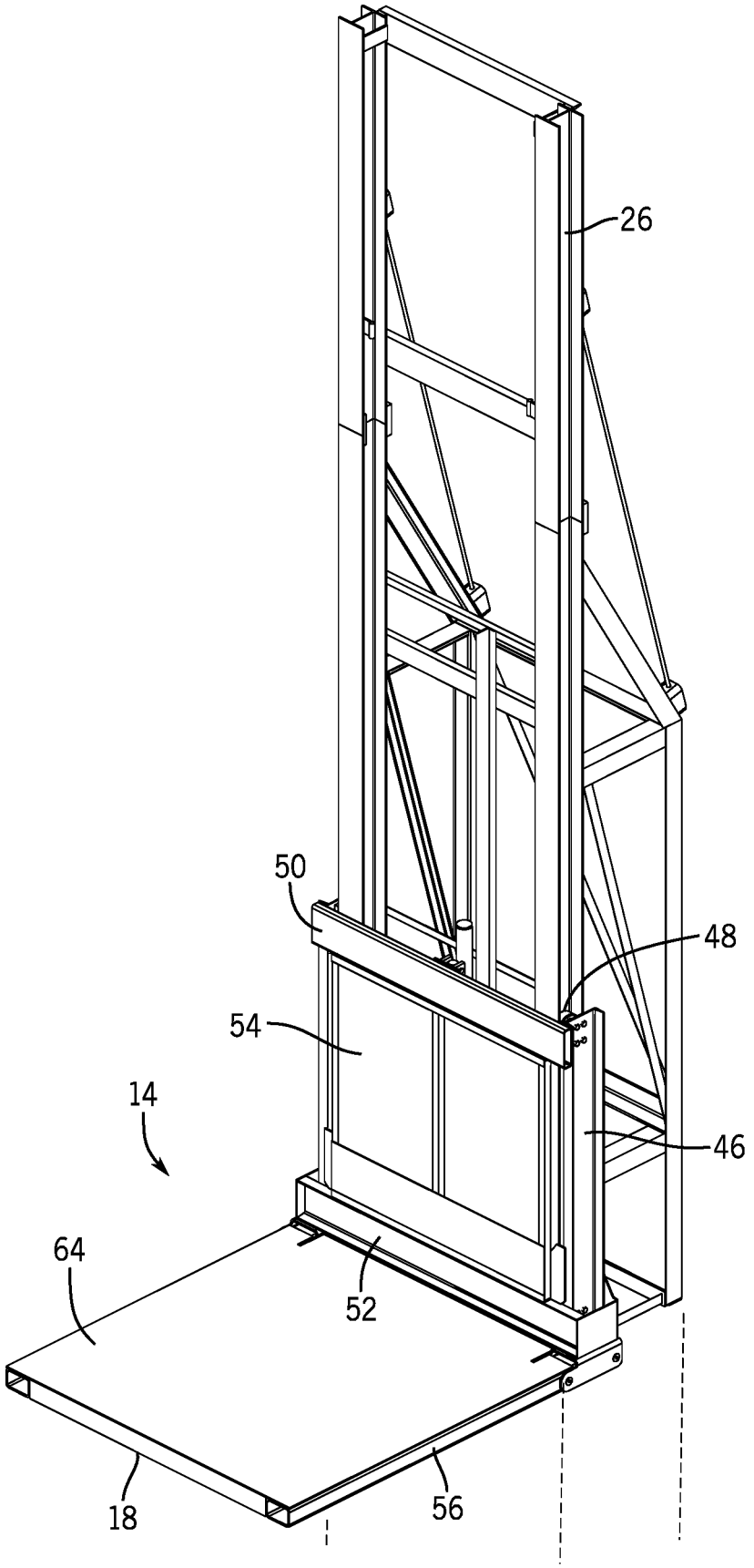
FIG. 3 is a front perspective view with the carriage assembly in a lowered position.
Figure 4:
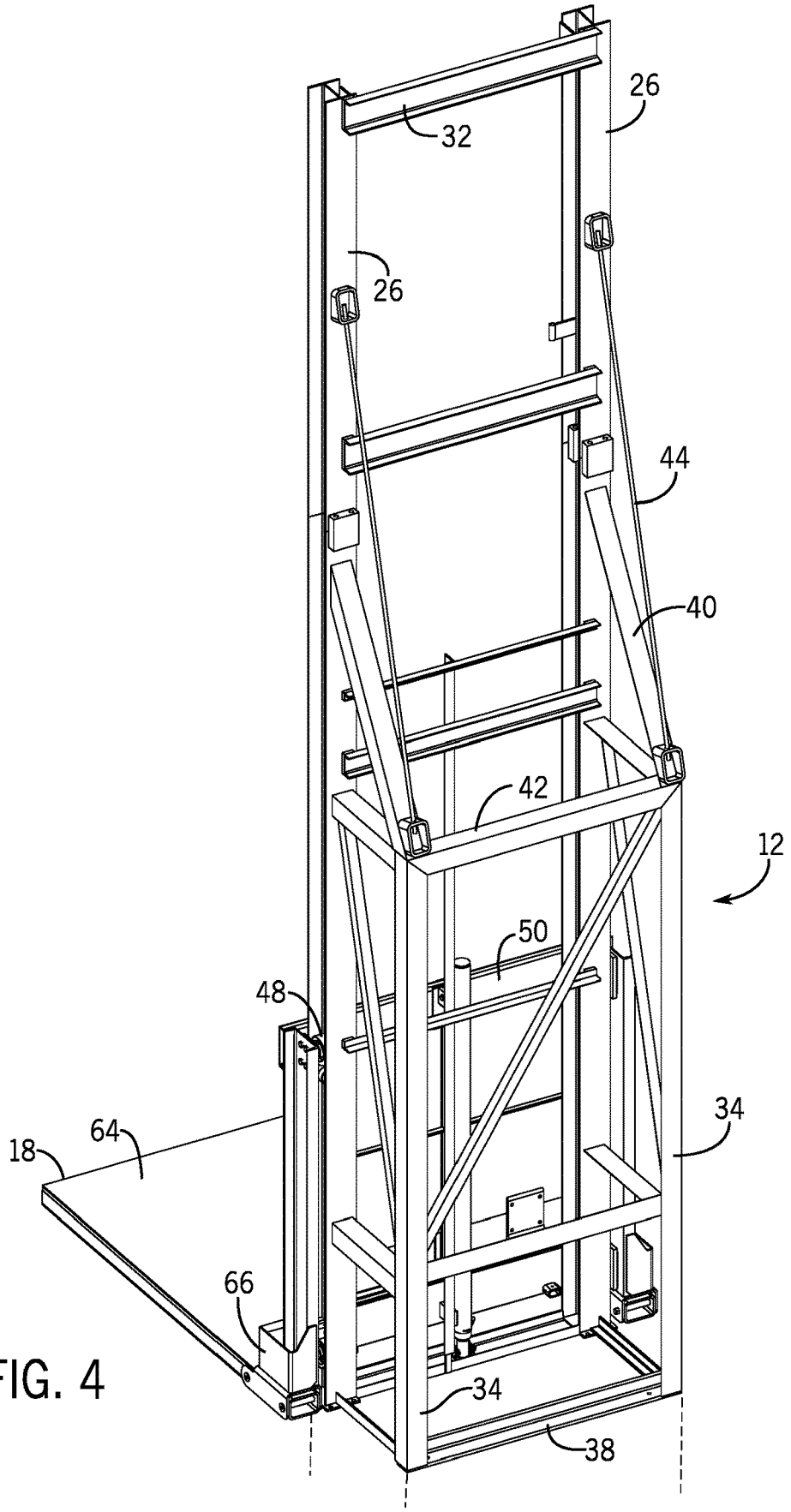
FIG. 4 is a rear perspective view with the carriage assembly in the lowered position.

Referring now to FIGS. 2 and 3, the carriage assembly 14 includes a carriage deck 18 that is pivotally mounted to a pair of uprights 46. Each of the uprights 46 includes upper and lower rollers 48 that are each sized to be received and movable within the roller slot 26 formed in each of the vertical rails 20. In the embodiment shown in the drawing figures, each of the rollers 48 travels within the roller slot 26 to guide the vertical movement of the carriage assembly 14 while preventing the carriage assembly from becoming dislodged from the vertical rails 20. In the embodiment shown in FIGS. 2 and 3, an upper cross bar 50 extends between the pair of uprights 46. A lower cross bar 52 also provides additional cross support for the pair of uprights 46. A back plate 54 is mounted between the pair of uprights 46 to prevent material from falling off of the carriage deck 18 during vertical movement.

As best shown in FIG. 1, a top end of a cylinder rod 55 is connected to the upper cross bar 50. The cylinder rod 55 forms part of the drive mechanism 16 that can be actuated to raise and lower the carriage assembly 14 along the length of the vertical rails 20. Although hydraulic cylinders are shown in the embodiment of FIG. 1 as forming the drive mechanism 16, other types of drive mechanisms could be utilized to move the carriage assembly 14 as described.

As can be seen in FIG. 2, the carriage deck 18 includes a pair of spaced side beams 56 that each extends between an outer end 58 and an inner end 60. In the embodiment shown in FIG. 2, each of the side beams 56 is a hollow, tubular member having a generally rectangular cross section. However, different configurations of each of the two side beams 56 are contemplated as being within the scope of the present disclosure.

As illustrated in the bottom view of FIG. 2, the pair of side beams 56 is joined to each other by a series of spaced cross supports 62. The cross supports 62 provide support for a platform 64 as best shown in FIG. 3. The platform 64 extends between the pair of side beams 56 and provides a smooth, upper support surface for materials and cargo being transported by the carriage assembly 14.

Figure 5:
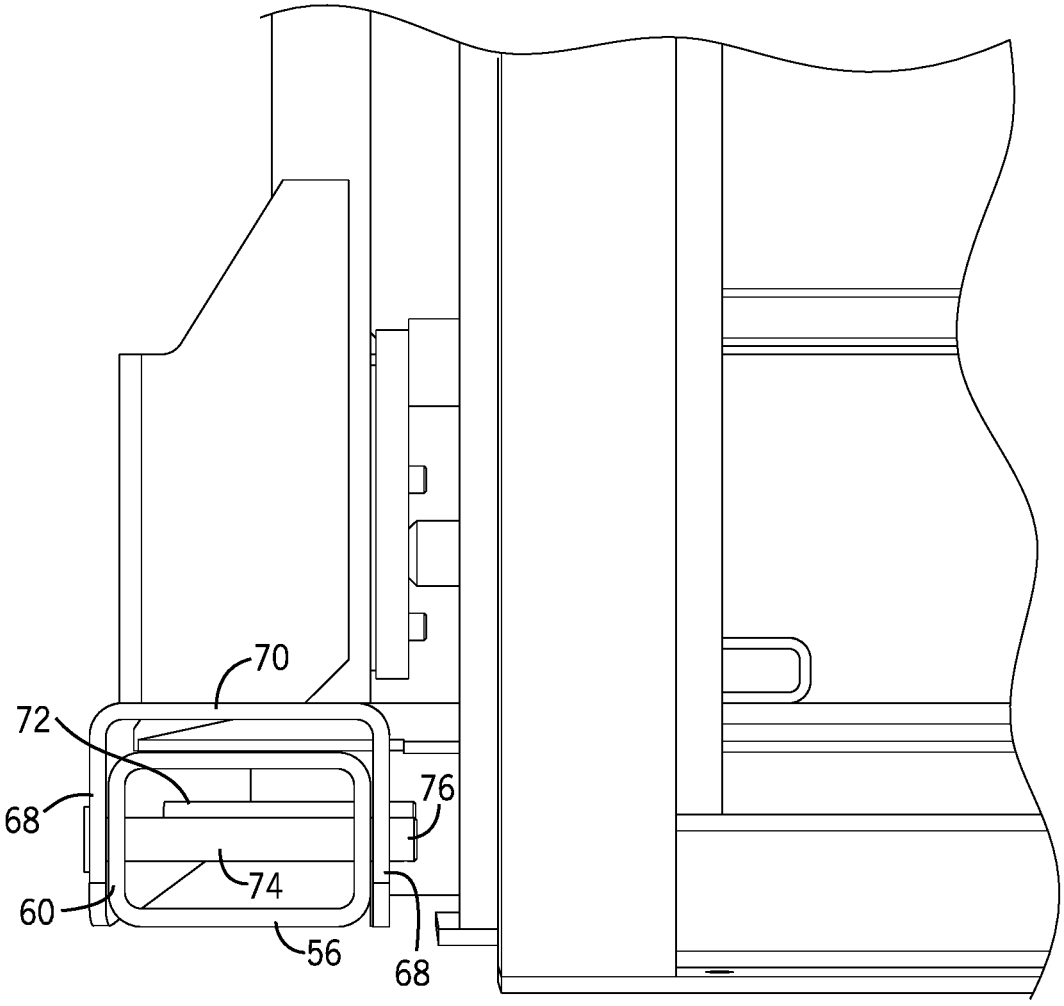
FIG. 5 is a magnified end view illustrating the mounting arrangement between the carriage deck and the uprights of the carriage assembly.

In order to facilitate the pivoting movement of the carriage deck 18, a pivot bracket 66 is securely mounted to each of the uprights 46. The pivot bracket 66 includes a pair of arms 68 that are spaced apart from each other and connected by a cross web 70, as best shown in FIG. 5. The arms 68 are spaced apart from each other by a distance that is slightly greater than the width of the side beam 56 such that the side beam 56 is received between the pair of arms 68. As shown in the rear view of FIG. 5, when the carriage deck is in the operating condition, the inner end 60 of the side beam 56 is generally aligned with the ends of each of the two arms 68.

Figure 6:
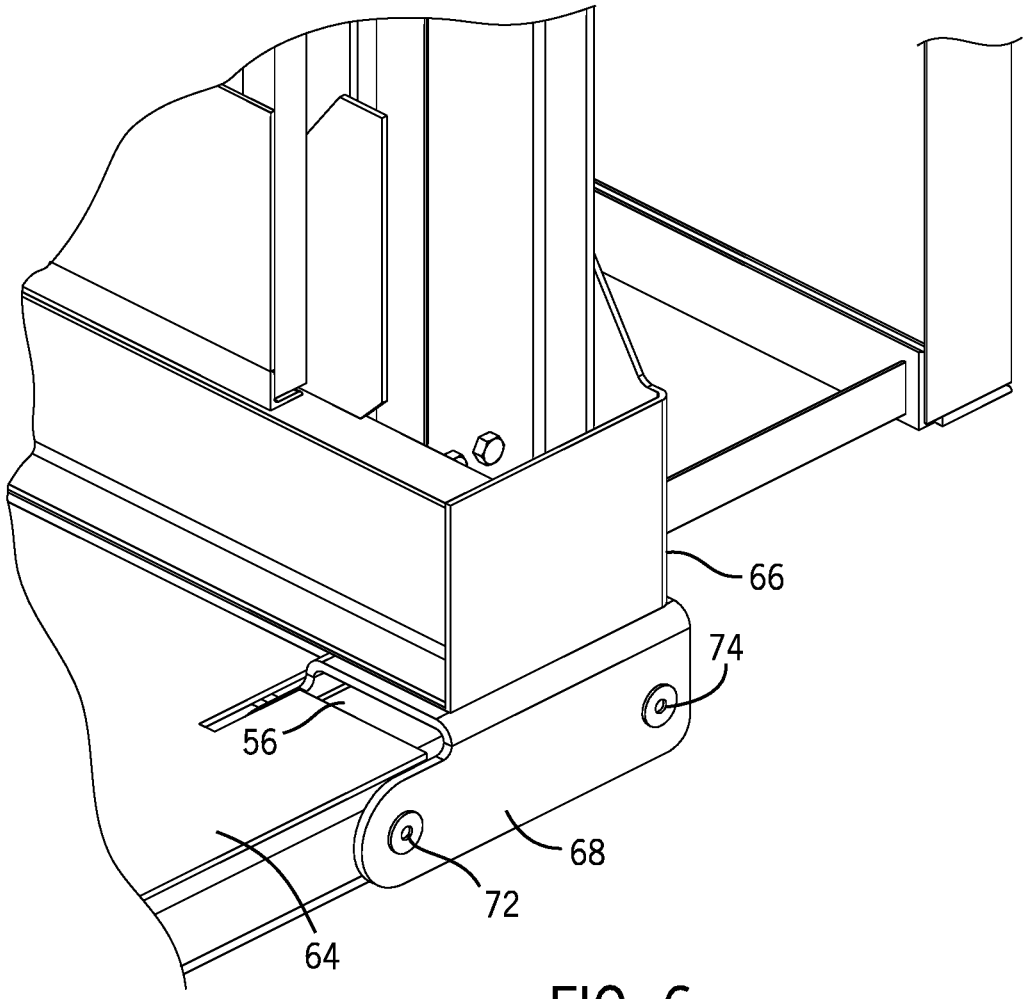
FIG. 6 is a magnified side perspective view of the mounting brackets.

Referring again to FIGS. 5 and 6, each of the side beams 56 is securely supported by one of the pivot brackets 66 through the use of a pivot pin 72. The pivot pin 72 extends through the pair of spaced arms 68 at a location spaced from the inner end 60 of the side beam 56. The pivot pin 72 allows the pair of side beams 56 to each pivot to the storage condition shown in FIGS. 7 and 8. The pivot pin 72 thus provides a fixed pivot point to allow the entire carriage deck 18 to move between the storage and operating conditions.

Referring back to FIGS. 5 and 6, when the carriage deck and the pair of side beams 56 are in the operating condition, a locking pin 74 extends through the open interior of the side beam 56. An inner end 76 of the locking pin 74 extends through the arm 68 as shown in FIG. 5. When the locking pin 74 is in the position shown, the locking pin 74 prevents the carriage deck 18 from moving into the storage condition.

Figure 10:
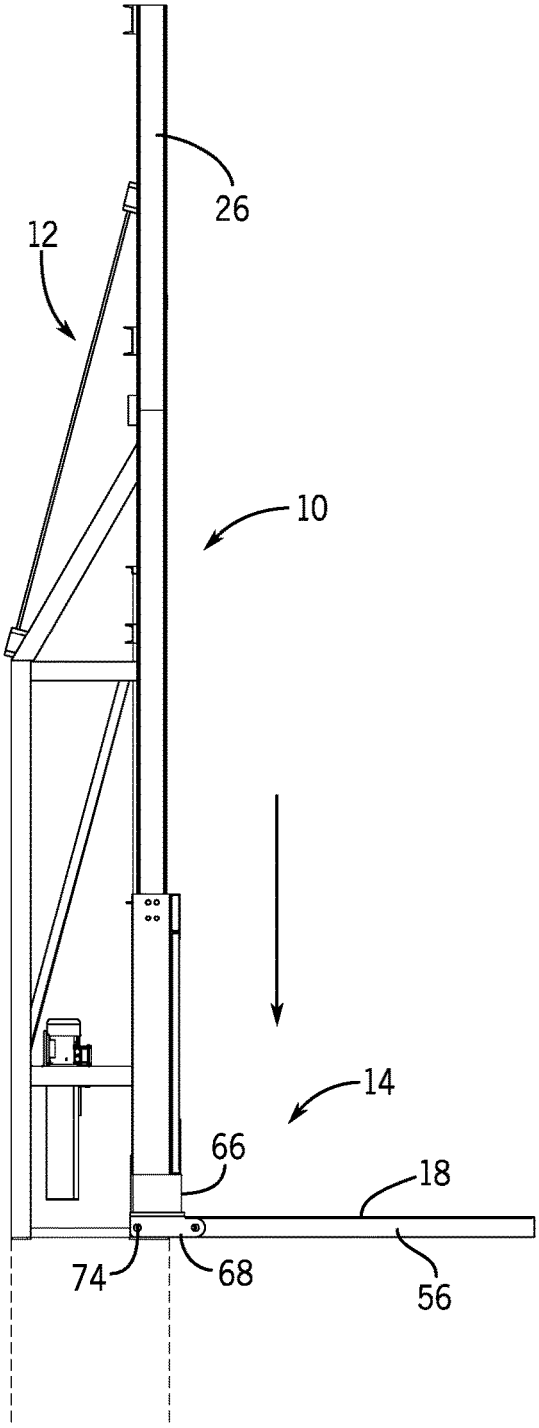
FIG. 10 is a side view of the carriage assembly in a lowered position.
Figure 11:
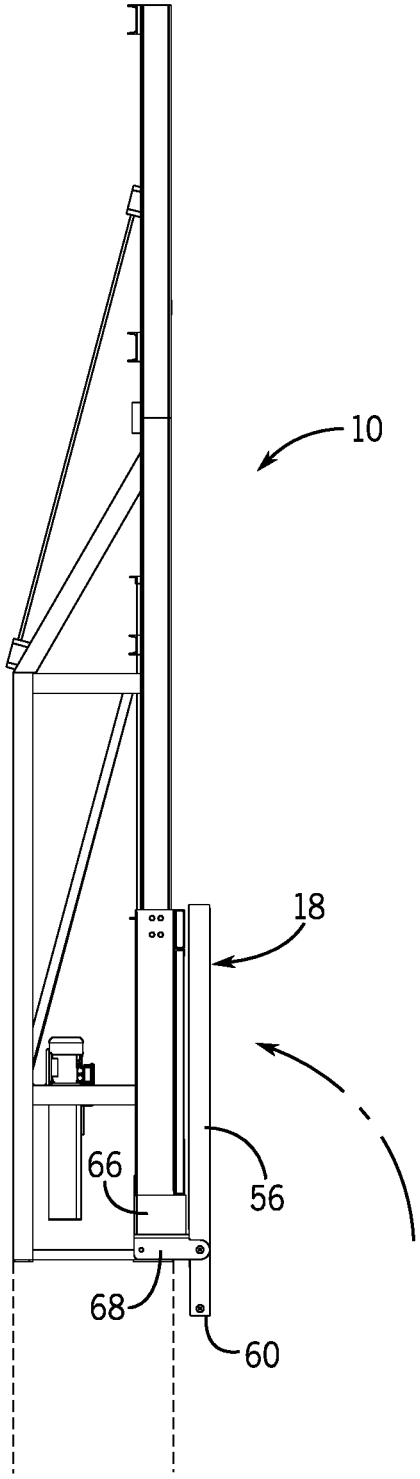
FIG. 11 is a side view of the movement of the carriage deck from the operating condition to the storage condition.
Figure 12:
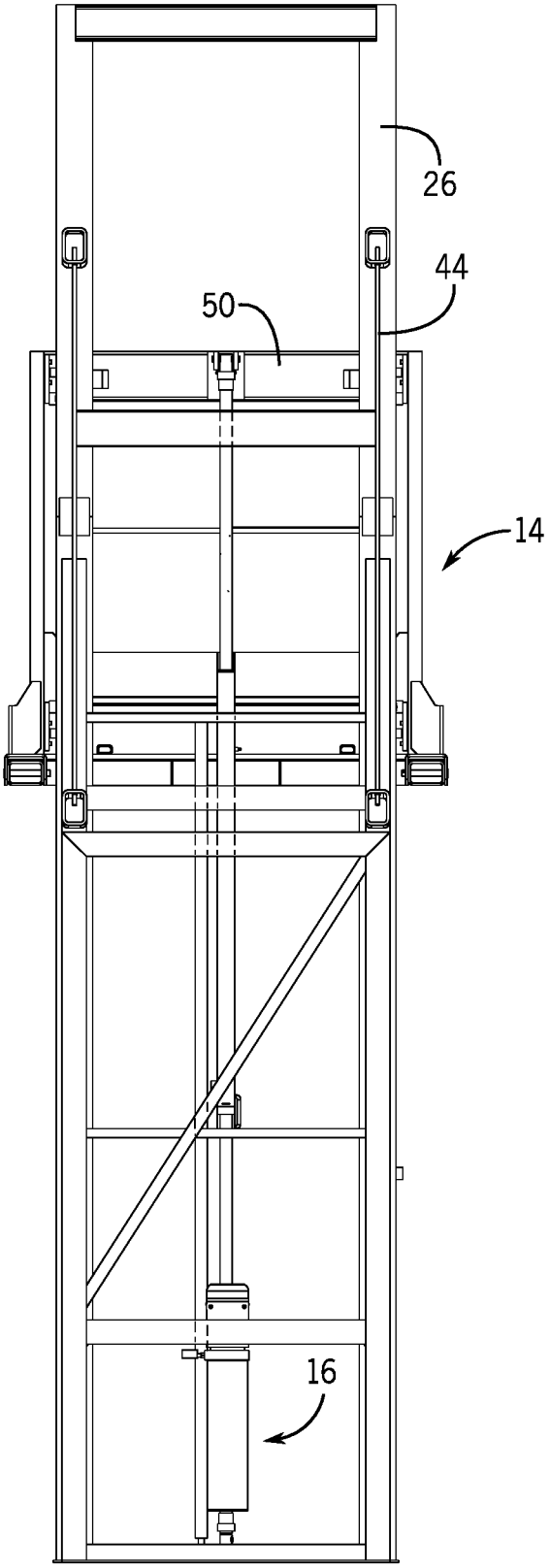
FIG. 12 is a rear view of the vertical reciprocating conveyor with the carriage assembly in the raised position.
Figure 13:
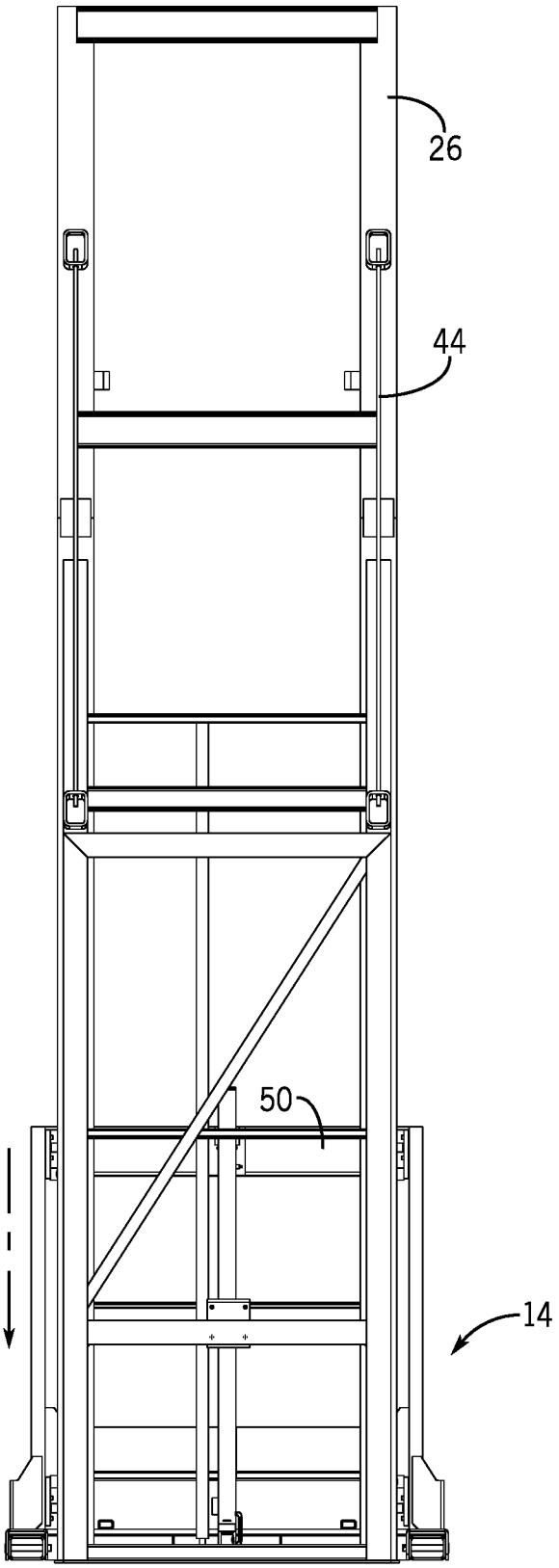
FIG. 13 is a rear view of the vertical reciprocating conveyor with the carriage assembly in the lowered position.

When an operator/installer wishes to move the carriage deck into the storage condition, the locking pin 74 is removed and the entire carriage deck can be pivoted about the pivot pins 72 to the storage condition as shown in FIG. 11. When the carriage deck 18 is in the storage condition, the overall width of the entire vertical reciprocating conveyor 10 is reduced as compared to the operating condition shown in FIG. 10. In another contemplated use, the entire carriage deck 18 can be removed and separated from the uprights 46 by removing both the pivot pins 72 and the locking pins 74. Once both sets of pins are removed, the carriage deck 18 can be separated from the rest of the carriage assembly for shipment. On-site, the carriage deck 18 can be re-installed on the carriage assembly by replacing the pivot pins 72 and the locking pins 74 without the need for any mechanical assembly process, such as welding.

Although the combination of the pivot pin 72 and the locking pin 74 are illustrated in the drawings as being the mechanism that allows the pivoting movement of the carriage deck 18 between the operating and storage positions, it should be understood that other mechanisms are contemplated as being within the scope of the present disclosure. In each case, the pivoting movement of the carriage deck 18 allows the overall width of the vertical reciprocating conveyor 10 to be reduced for shipping and transportation while allowing the assembly of the vertical reciprocating conveyor 10 without the need for welding or other construction techniques.

Figure 9:
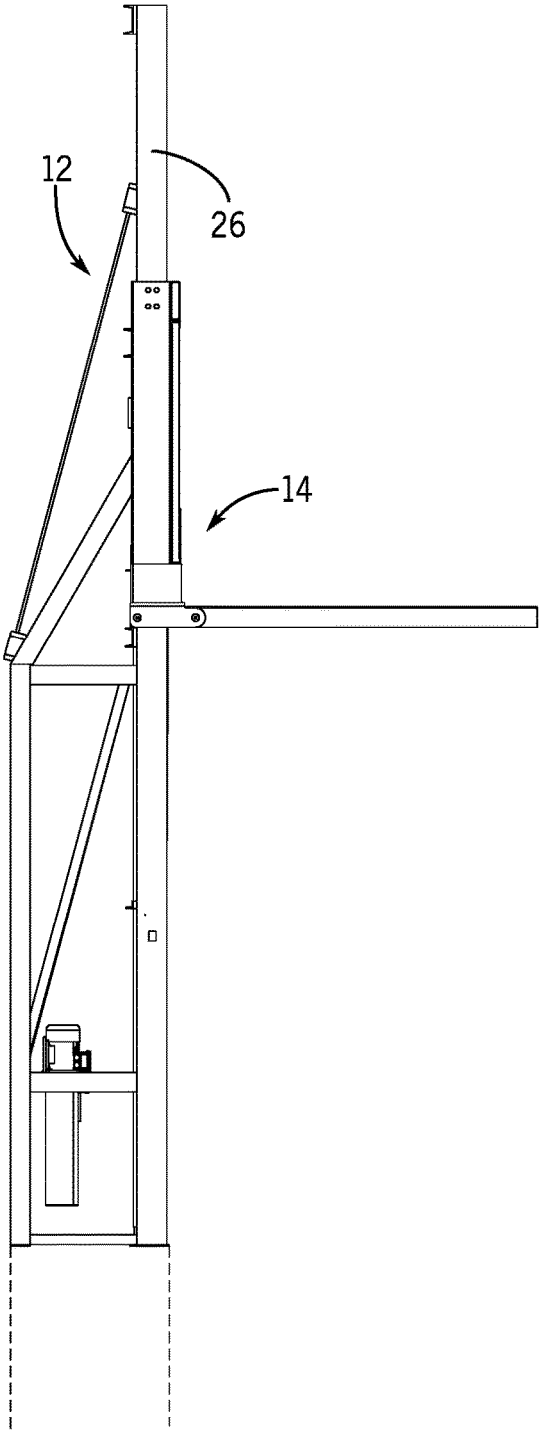
FIG. 9 is a side view of the carriage assembly in the raised position.

When the vertical reciprocating conveyor 10 is installed after shipment, the carriage deck 18 is moved in a direction opposite the arrows shown in FIG. 11 until the carriage deck reaches the operating condition shown in FIG. 10. In this condition, the locking pin 74 is inserted, which holds the carriage deck and the pair of spaced side beams 56 in the operating position. In the operating position, the carriage assembly 14 can be moved upward and downward along the support frame 12 as shown in FIGS. 9 and 10.

As can be understood by the above description, the entire vertical reciprocating conveyor 10 can be assembled at the manufacturing facility and shipped as an assembled unit with the carriage deck 18 in the storage condition to reduce the size of the unit for shipping. The pivoting/removable carriage deck 18 not only reduces the size of the conveyor for shipping but also allows the drive mechanism to be pre-installed at the factory, saving installation time. As an example, when the drive mechanism is a hydraulic unit as depicted, the hydraulic cylinder would normally have been shipped loose, with no oil. With the new design, the hydraulic cylinder can be pre-mounted on the support frame and, connected to the hydraulic power unit, filled with oil and air bled from the entire system, all prior to shipping. This same concept applies for mechanically powered cantilever style lifts, where the overhead gear-motor drive, lifting chains, and associated components can all be pre-mounted saving significant installation time This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A vertical reciprocating conveyor comprising:

a frame including a pair of spaced vertical rails;

a carriage assembly movable along the pair of spaced vertical rails; and a drive mechanism operable to move the carriage along the pair of spaced vertical rails between a plurality of vertical positions, wherein the carriage assembly comprises:

a pair of spaced uprights;

a pair of pivot brackets each mounted to a lower end of one of the pair of spaced uprights, each of the pivot brackets including a pair of spaced arms that extend perpendicular to the pair of spaced uprights; and a carriage deck including a pair of spaced side beams and a platform mounted between the pair of side beams, wherein the pair of side beams define an entire width of the carriage deck and each extend between an outer end and an inner end, wherein of the side beams is pivotably mounted between the pair of spaced arms of one of the pair of pivot brackets at a mounting location spaced from the inner end of the side beam, wherein the side beams are pivotable between the pair of spaced arms of the pivot brackets and are movable between an operating condition and a storage condition, wherein the carriage deck is perpendicular to the pair of spaced uprights in the operating condition and parallel to the pair of spaced uprights in the storage condition.

2. The vertical reciprocating conveyor of claim 1 wherein each of the pivot brackets includes a pivot pin and a locking pin, wherein the pivot pin provides a pivoting connection between one of the side beams and the pivot bracket and the locking pin is positionable at a location between the pivot pin and the inner end of the side beam to secure the side beams to the pivot bracket when the carriage deck is in the operating condition.

3. A carriage assembly for use with a vertical reciprocating conveyor including a frame having a pair of space vertical rails and a drive mechanism operable to move the carriage assembly along the pair of vertical rails, comprising:

a pair of spaced uprights;

a pair of pivot brackets each mounted to a lower end of one of the pair of spaced uprights, each of the pivot brackets including a pair of spaced arms that extend perpendicular to the pair of spaced uprights; and a carriage deck including a pair of spaced side beams and a platform mounted between the pair of side beams, wherein the pair of side beams define an entire width of the carriage deck and each extend between an outer end and an inner end, wherein of the side beams is pivotably mounted between the pair of spaced arms of one of the pair of pivot brackets at a mounting location spaced from the inner end of the side beam, wherein the side beams are pivotable between the pair of spaced arms of the pivot brackets and are movable between an operating condition and a storage condition, wherein the carriage deck is perpendicular to the pair of spaced uprights in the operating condition and parallel to the pair of spaced uprights in the storage condition.

4. The carriage assembly of claim 3 wherein each of the pivot brackets includes a pivot pin and a locking pin, wherein the pivot pin provides a pivoting connection between one of the side beams and the pivot bracket and the locking pin is positionable at a location between the pivot pin and the inner end of the side beam to secure the side beams to the pivot bracket when the carriage deck is in the operating condition.

5. The carriage assembly of claim 4 wherein the pivot pin extends through the one of the pair of pivot brackets and one of the pair of side beams at a location spaced from the inner end.

* * * * *